US009974395B2

(12) United States Patent
Pennington et al.

(10) Patent No.: US 9,974,395 B2
(45) Date of Patent: May 22, 2018

(54) MATTRESS SPRING ASSEMBLY

(71) Applicant: Diamond Mattress Company, Inc., Compton, CA (US)

(72) Inventors: Randy Pennington, Compton, CA (US); Shaun Pennington, Rossmoor, CA (US); Salvador Hernandez, Lynwood, CA (US)

(73) Assignee: DIAMOND MATTRESS COMPANY, INC., Compton, CA (US)

( * ) Notice: Subject to any disclaimer, the term of this patent is extended or adjusted under 35 U.S.C. 154(b) by 330 days.

(21) Appl. No.: 14/615,885

(22) Filed: Feb. 6, 2015

(65) Prior Publication Data

US 2016/0227938 A1 Aug. 11, 2016

(51) Int. Cl.

| | |
|---|---|
| ***A47C 27/07*** | (2006.01) |
| ***A47C 27/06*** | (2006.01) |
| ***A47C 23/043*** | (2006.01) |

(52) U.S. Cl.

CPC ..... *A47C 27/07* (2013.01); *A47C 23/043* (2013.01); *A47C 27/06* (2013.01); *A47C 27/064* (2013.01)

(58) Field of Classification Search

CPC ..... A47C 27/07
USPC ..... 5/716, 720, 655.8
See application file for complete search history.

(56) References Cited

U.S. PATENT DOCUMENTS

| | | | | |
|---|---|---|---|---|
| 1,528,066 | A * | 3/1925 | McEntire | A47C 27/001 5/722 |
| 4,213,214 | A * | 7/1980 | Gilhooly | A47C 27/001 5/679 |
| 5,868,393 | A * | 2/1999 | Williams | A63F 1/00 273/299 |
| 6,295,676 | B1 | 10/2001 | Warner | |
| 6,339,857 | B1 | 1/2002 | Clayton | |
| 6,353,952 | B1 * | 3/2002 | Wells | A47C 27/062 5/716 |
| 6,813,791 | B2 * | 11/2004 | Mossbeck | A47C 27/064 5/716 |
| 6,948,348 | B2 | 9/2005 | Wells et al. | |
| 2002/0113348 | A1 | 8/2002 | Barber | |
| 2002/0195756 | A1 | 12/2002 | Wells et al. | |
| 2003/0074736 | A1 | 4/2003 | Grothaus | |
| 2004/0128773 | A1 | 7/2004 | Barber | |

(Continued)

FOREIGN PATENT DOCUMENTS

WO WO 2012/028763 A1 3/2012

OTHER PUBLICATIONS

"Trends in Springs & Foams—The Core Components" [online]; Published Aug. 31, 2011 [retrieved on Jul. 25, 2014]; Retrieved from http://bedtimesmagazine.com/2011/08/trends-in-springs-foams-the-core-components/.

(Continued)

*Primary Examiner* — Frederick C Conley
(74) *Attorney, Agent, or Firm* — Woodard, Emhardt, Moriarty, McNett & Henry LLP

(57) ABSTRACT

A mattress is configured to have multiple zones made of springs configured in different orientations. A first zone of the mattress has springs packed in a first pattern, and a second zone has the springs packed in a second pattern that is different from the first pattern. The springs in the first zone and the second zone are the same type of springs. By packing the same springs in different patterns, the zones can have different firmness levels.

24 Claims, 6 Drawing Sheets

(56) References Cited

U.S. PATENT DOCUMENTS

| | | | | |
|---|---|---|---|---|
| 2004/0133988 | A1 | 7/2004 | Barber | |
| 2005/0166329 | A1 | 8/2005 | Carlitz | |
| 2005/0235426 | A1 | 10/2005 | Colman et al. | |
| 2007/0094807 | A1 | 5/2007 | Wells | |
| 2009/0064420 | A1* | 3/2009 | Rawls-Meehan ..... | A47C 7/027 5/740 |
| 2009/0106908 | A1 | 4/2009 | DeFranks et al. | |
| 2009/0193591 | A1 | 8/2009 | DeMoss et al. | |
| 2013/0232699 | A1 | 9/2013 | Hinshaw | |

OTHER PUBLICATIONS

"Therapedic Tommy Bahama Home Collection Reviews" [retrieved Sep. 2, 2015]. 7 pages. Retrieved from the Internet: <URL: http://www.beds.org/mattress/therapedic-tommy-bahama-home-collection.php>.

"Therapedic Tommy Bahama Mattresses—Hybrid Collection" [retrieved Sep. 16, 2015]. 2 pages. Retrieved from the Internet: <URL: https://www.therapedic.com/mattresses/tommy-bahama/hybrid/>.

* cited by examiner

MATTRESS SPRING ASSEMBLY

BACKGROUND

Everyone enjoys a good night's sleep. However, almost everyone has at one time or another suffered through the unpleasant experience of sleeping on an uncomfortable mattress. If not properly supported, an individual can toss and turn throughout the night attempting to find a comfortable sleeping position. For example, when the mattress is too stiff for an individual, pressure points can be created which in turn can make an individual sleeping or even lying on the mattress very uncomfortable. Conversely, mattresses can also be too soft and not provide adequate support which can make the mattress uncomfortable as well. Different parts of the body also require different levels of support. Heavier parts of the body, such as the torso region, usually require greater support or stiffness as compared to lighter parts of the body, such as the head and feet regions. Individual tastes in mattress stiffness can dramatically vary as well. Numerous mattress designs have been proposed to compensate for or reduce the different pressure points on the body so as to provide a comfortable mattress, but these designs can require expensive materials or can be quite difficult to manufacture at high enough volumes so as to make them inexpensive. As a result, most of these mattress designs are too expensive for the average consumer. Thus, there is a need for improvement in this field.

SUMMARY

Aspect 1 concerns a mattress, comprising a first zone having springs packed in a first pattern; a second zone having the springs packed in a second pattern that is different from the first pattern; and wherein the springs in the first zone and the second zone have the same stiffness.

Aspect 2 concerns the mattress of any preceeding aspects, wherein the springs in the first zone and the second zone are the same.

Aspect 3 concerns the mattress of any preceeding aspects, wherein the springs in the first zone have a packing density that is less than the packing density of the springs in the second zone.

Aspect 4 concerns the mattress of any preceeding aspects, wherein the springs in the first zone have a packing density that is greater than the packing density of the springs in the second zone.

Aspect 5 concerns the mattress of any preceeding aspects, wherein the first pattern is a cube pattern; and the second pattern is a hexagonal pattern.

Aspect 6 concerns the mattress of any preceeding aspects, further comprising a third zone having the springs packed in a third pattern.

Aspect 7 concerns the mattress of any preceeding aspects, wherein the first pattern and the third pattern are the same pattern.

Aspect 8 concerns the mattress of any preceeding aspects, wherein the first pattern and the third pattern have a cube pattern; and the second pattern is a hexagonal pattern.

Aspect 9 concerns the mattress of any preceeding aspects, further comprising a fourth zone having the springs packed in a fourth pattern; a fifth zone having the springs packing in a fifth pattern; wherein the first pattern, the third pattern, and fifth pattern are the same; and wherein the second pattern and the fourth pattern are the same.

Aspect 10 concerns the mattress of any preceeding aspects, wherein the springs are pocket springs.

Aspect 11 concerns the mattress of any preceeding aspects, wherein the mattress has a width; and the first pattern of the springs in the first zone extend for the entire width of the mattress; and the second pattern of the springs in the second zone extend for the entire width of the mattress.

Aspect 12 concerns the mattress of any preceeding aspects, further comprising an upholstery layer covering the first zone and the second zone.

Aspect 13 concerns a mattress, comprising a first zone having springs packed in a first pattern; a second zone having the springs packed in a second pattern that is different from the first pattern; wherein the first pattern of the springs in the first zone extend for an entire width of the mattress; and wherein the second pattern of the springs in the second zone extend for the entire width of the mattress.

Aspect 14 concerns the mattress of any preceeding aspects, wherein the springs in the first zone and the second zone are the same.

Aspect 15 concerns the mattress of any preceeding aspects, wherein the first pattern is a cube pattern; and the second pattern is a hexagonal pattern.

Aspect 16 concerns the mattress of any preceeding aspects, comprising packing springs in a first pattern in a first zone of a core of a mattress; packing the springs in a second pattern that is different from the first pattern in a second zone of the core; and wherein the springs in the first zone and the second zone are the same.

Aspect 17 concerns the mattress of any preceeding aspects, wherein said packing the springs in the first pattern includes packing the springs in a cube pattern; and said packing the springs in the second pattern includes packing the springs in a hexagonal pattern.

Aspect 18 concerns the mattress of any preceeding aspects, wherein said packing the springs in the first pattern includes packing the springs for an entire width of the mattress in the first pattern; and said packing the springs in the second pattern includes packing the springs for the entire width of the mattress in the second pattern.

Aspect 19 concerns the mattress of any preceeding aspects, further comprising packing the springs in a third pattern in a third zone of the core, wherein the second zone is sandwiched between the first zone and the second zone; and wherein the first pattern and the second pattern have the same pattern.

Aspect 20 concerns the mattress of any preceeding aspects, further comprising assembling a second core of a second mattress that has a firmness profile different from a firmness profile created by the first and second zones of the mattress.

DESCRIPTION OF THE SELECTED EMBODIMENTS

Figure 1:
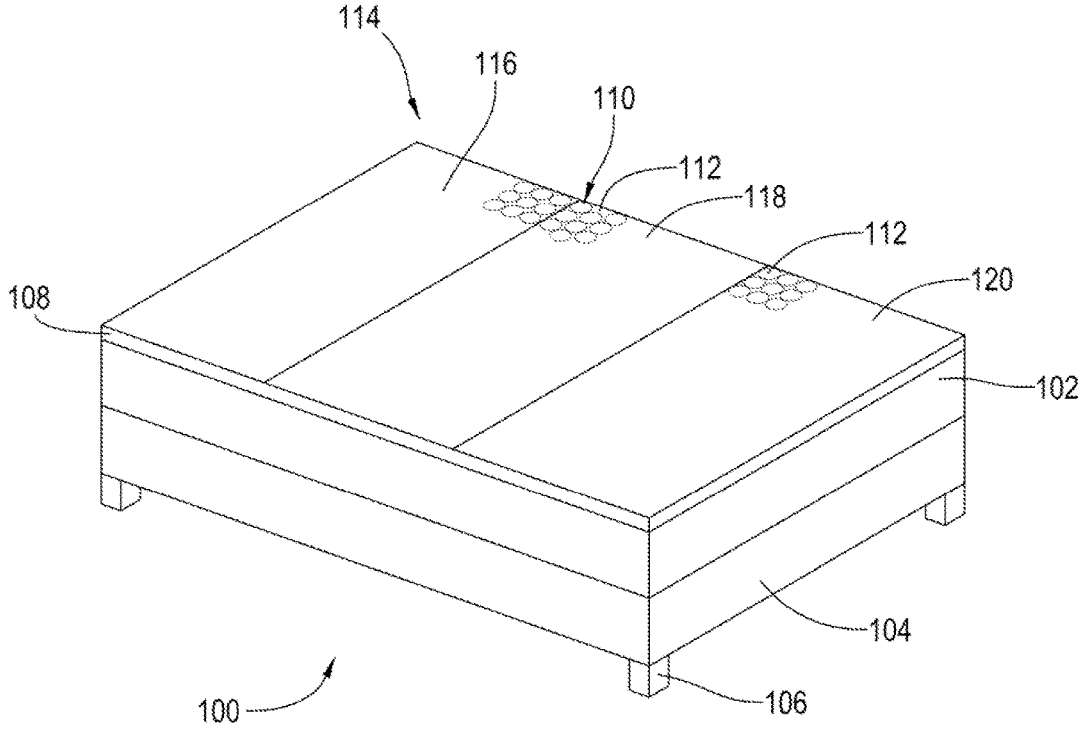
FIG. 1 is a perspective view of a bed with a mattress that incorporates multiple mattress spring zones.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
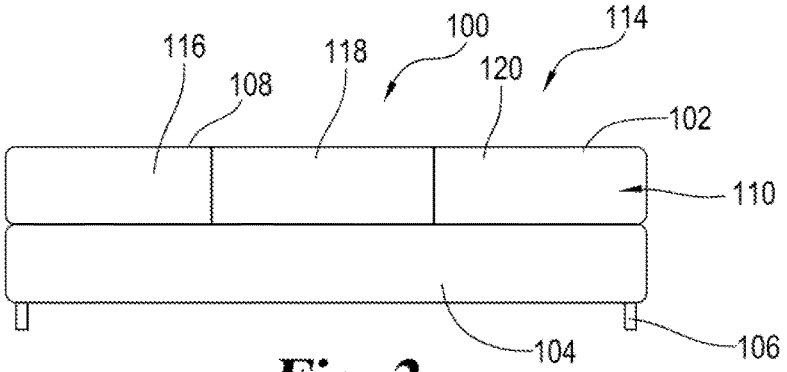
FIG. 2 is a top view of the FIG. 1 mattress with its upholstery layer removed.

FIG. 1 shows a perspective view of a bed assembly 100, and FIG. 2 illustrates a side view of the bed 100. As shown, the bed 100 includes a mattress 102 that rests upon a foundation 104, and the foundation 104 rests on a frame 106. In the illustrated example, the mattress 102 is an inner spring type mattress. The mattress 102 includes an upholstery or comfort layer 108 that covers an inner core or support layer 110. In FIG. 1, a portion of the upholstery layer 108 has been removed to show or expose the core 110. As can be seen, the inner core 110 includes a series of springs 112 that are packed together. The mattress 102 includes a series of zones 114 that have different softnesses for stiffness levels, depending on how the springs 112 are packed in the zones 114. In the illustrated example, the core 110 of the mattress 102 includes three zones 114, that is, first 116, second 118, and third 120 zones. In one example, the second zone 118, which is positioned around the typical torso of an individual, is more firm then the first 116 and third 120 zones, which are typically located at the head and feet of the individual. It should be recognized that all three zones 114 in other examples can have different combinations of firmness levels.

As will be expanded upon in greater detail below, the mattress 102 is configured to have these zones 114 with different firmness levels that use the same type of spring 112. By using the same spring 112 in all of the zones 114, the mattress 102 can be produced in a less expensive manner because the manufacturing process for the mattress 102 is simplified. The robots and other machinery used to position the springs 112 in the zones 114 can use consistent articulators and actions because the springs 112 have the same physical characteristics. In other words, there is no need to make adjustments to the equipment for different sized, weighted, and/or shaped springs. Moreover, having the same type of spring 112 used in each of the zones 114 reduces inventory costs because different types of springs are not required to form each of the zones 114.

Figure 3:
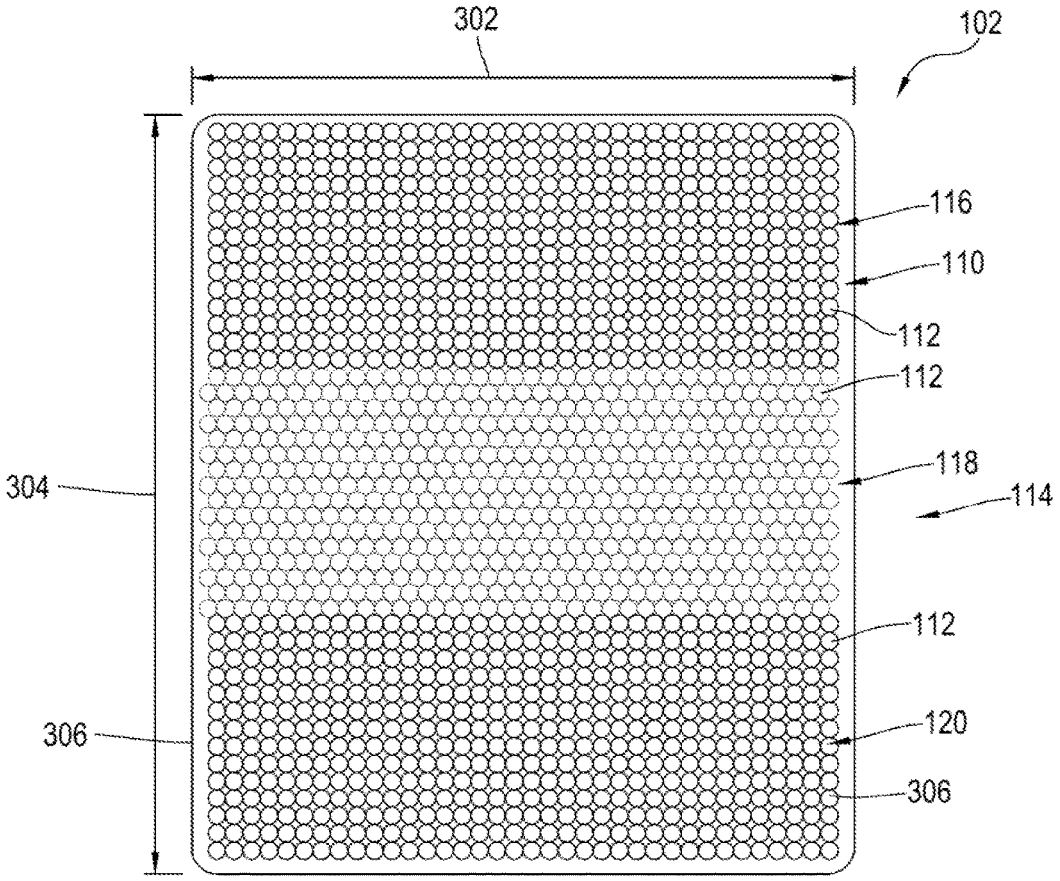
FIG. 3 is a side view of the FIG. 1 mattress.

FIG. 3 shows a top view of the mattress 102 with the upholstery layer 108 removed in order to show the zones 114 of the core 110. In the illustrated example, the zones 114 each generally have an overall rectangular shape. It is desirable for some areas of the mattress 102 to be firmer than other areas of the mattress 102 to provide extra support at the areas where a person is putting most of their weight on the mattress. The extra support from the mattress 102 at specific areas can promote proper body alignment during sleep and slow deformation of the mattress 102 over time. As an example, in FIG. 2, the second zone 118, which is firmer than the other zones 116, 120, is located in the middle of mattress where the torso of a person would normally be located if that person were laying on the mattress 102.

As can be seen in FIG. 3, the springs 112 in the second zone 118 are packed more densely as compared to the first 116 and third 120 zones. Consequently, the second zone 118 is firmer than the other zones 116, 120. In particular, the springs 112 in the first 116 and third 120 zones are packed in a square configuration in which the springs 112 are arranged in uniform rows and columns such that these zones 116, 120 have a lower packing density and are thus softer. In contrast, the springs 112 in the second zone 118 are tightly packed in a hexagonal packing arrangement so as to provide higher packing density which in turn increases the firmness of the second zone 118. The hexagonal or honeycomb packing arrangement of the springs 112 within the second zone 118 provides the densest packing arrangement as possible for these rectangular-shaped zones 114. As a result, the portion of the mattress 102 that includes the second zone 118 with the springs 112 packed in the hexagonal packing arrangement is firmer and provides more support than the other zones 116, 120 without needing to use different types of springs 112 or change the physical characteristics of the springs 112. To put it another way, the springs 112 with the same physical characteristics (e.g., stiffness, size, shape, etc.) can be used to form zones 114 having different firmness levels by packing the springs 112 in different arrangements. The springs 112 located in the second zone 118 have the same coil gauge and spring coefficient as the springs 112 located in the other zones 114. This makes production of the mattress 102 more efficient and less costly than assemblies that require different kinds of springs 112 to provide variations in support. Of course, the zones 114 in other examples can have different packing arrangements than is shown so as to provide different firmness/softness levels. Moreover, while the springs 112 are packed in uniform packing arrangements in the illustrated example, it is envisioned that the springs 112 in certain other examples can have nonuniform packing arrangements.

As depicted, the mattress 102 has a width 302 and a length 304 which can vary depending on the desired size of the mattress. The mattress 102 can come in various sizes, such as in single, double, queen, and king sizes, to name just a few examples. The zones 114 extend for the entire width 302 of the mattress 102, and the different zones 114 are arranged in rows along the length 304 of the mattress 102. Having the zones 114 extend for the entire width 302 of the mattress allows the individual to experience the same customized firmness/softness levels when they roll over during sleep, even when near side edges 306 of the mattress 102. In other words, the zones 114 extend completely between the side edges 306 of the mattress 102 so as to provide optimal comfort no matter where an individual sleeps on the bed 100. Even when the zones 114 extend for the entire width 302 of the mattress 102, the periphery of the mattress 102 in some forms can be wrapped in other materials such a foam and/or cloth so as to enclose the springs and provide protection. In other words, the zones 114 are considered to extend for the entire width 302 of the mattress 102 even though ancillary material, such as foam and cloth, may surround the sides and/or ends of the zones 114 so as to provide some padding around the periphery of the mattress 102. In one example, the zones 114 that extend for the entire width 302 of the mattress 102 are surrounded by foam along the periphery of the mattress 102.

Figure 4:
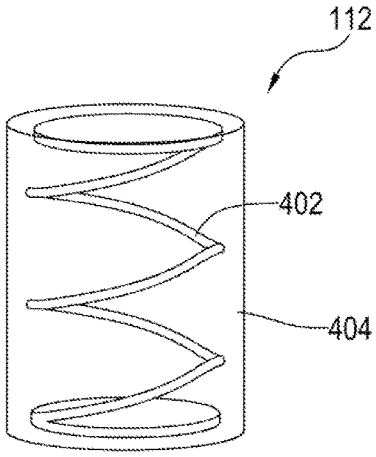
FIG. 4 is a side view of a pocket spring used in the FIG. 1 mattress.

FIG. 4 shows a cross-sectional view of one example of the spring 112 used in the mattress 102. In this particular example, the spring 112 is a pocket spring, sometimes referred to as wrapped coils or Marshall coils. As should be recognized, the pocket spring includes a barrel shaped, knotless coil 402 that is individually enclosed in a fabric pocket 404. The wrapping material for the pocket 404 can be a fabric and/or another soft material that provides more comfort than the metal used to make the spring. The fabric pocket 404 of one spring 112 can be attached to material of another pocket 404 to connect the springs 112 together. The attachment of each pocket type spring 112 can be made by sewing together the surrounding materials of adjacent springs 112. Other connection methods that allow each spring to move individually may also be used as well. By individually wrapping each coil 402, a single spring 112 can move independently of the other springs 112 that make up the mattress 102. This allows better support of body mass and less movement of the rest of the mattress 102 when a person moves, sits, and/or stands on one section of the bed 100. It is contemplated that in other examples other types of springs 112 can be used. For example, the springs 112 in other types of mattresses 102 can include Bonnell, offset, and/or continuous coils.

Connecting the individual spring 112 to form the core 110 may be accomplished using a variety of methods. In some examples, the springs 112 may be connected as an open coil mattress, where the springs 112 are connected by wires. In other examples, the springs 112 may be connected as pocket springs, where each spring is individually wrapped. When this kind of connection is used, each spring 112 acts independently, so when force is applied to one portion of mattress 102, the springs 112 at other portions of the mattress 102 are not moved. The number of springs 112 that are connected may vary to form mattresses 112 of various sizes. The springs 112 may also be arranged in different orientations that are not necessarily rectangular. For example, the springs 112 in some examples may be connected to form a circular or triangular shape.

Figure 5:
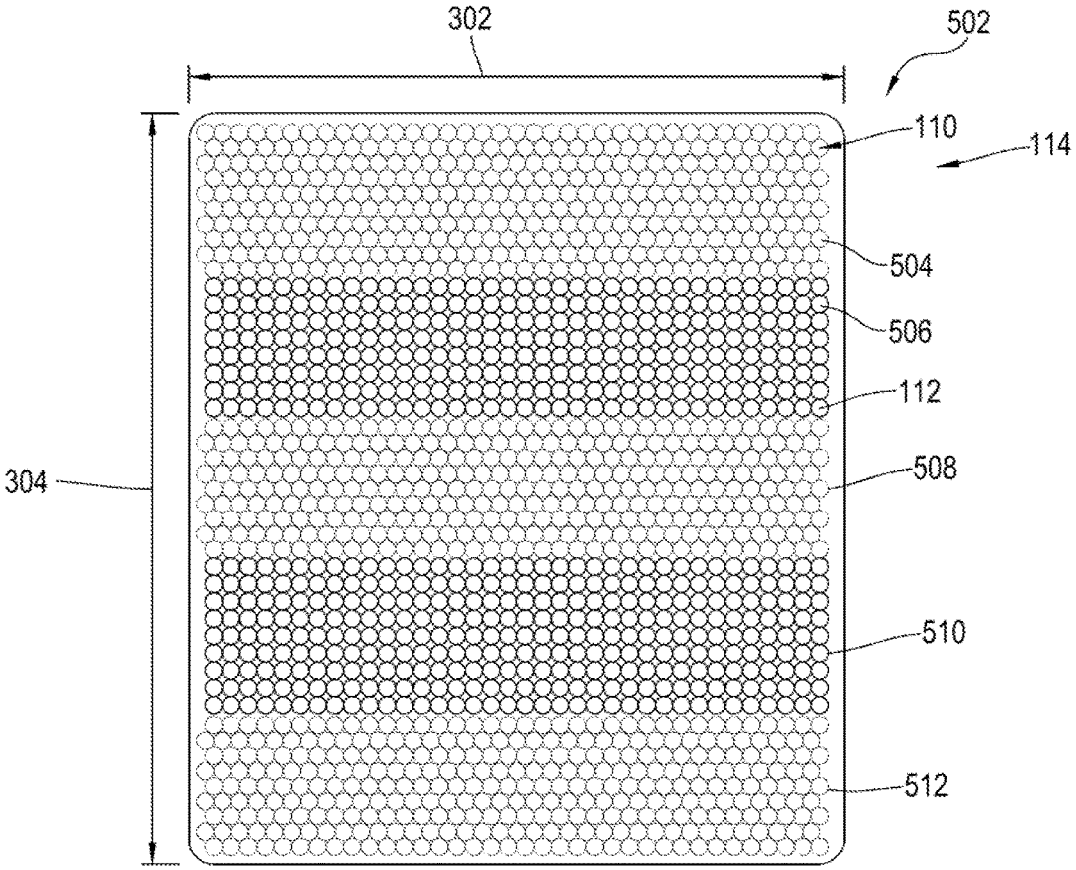
FIG. 5 is a top view of a spring core for a mattress that includes five mattress spring zones.
Figure 6:
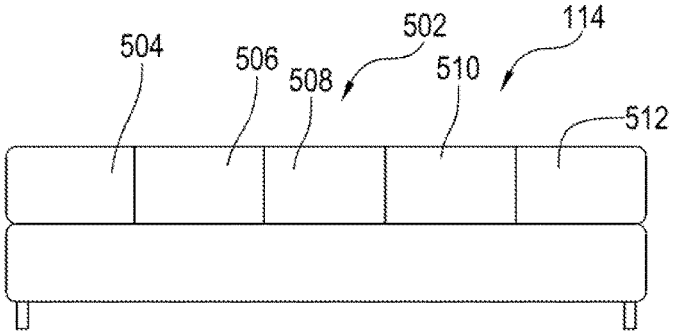
FIG. 6 is a side view of the mattress shown in FIG. 5.

It should be recognized that the mattress 102 can include more or less zones 114 than illustrated in FIGS. 1, 2, and 3. For example, it is contemplated that the mattress 102 can include just two zones 114 that have the springs 112 packed in different arrangements to provide different firmness levels. FIGS. 5 and 6 show an alternative embodiment of a mattress 502 that has five zones 114 instead of the three zones 114 as shown in FIG. 3. As can be seen, the mattress 502 includes first 504, second 506, third 508, fourth 510, and fifth 512 zones that are arranged in rows along the length 304 of the mattress 502. All of the zones 114 in the mattress 502 extend entirely across the width 302 of the mattress 502 so that a person experiences the same firmness profile when rolling over in the bed 100. In this example, the springs 112 in at least one of the zones 114 have a different packing arrangement than the other zones 114 so as to provide a different firmness profile. In this particular example, the springs 112 in the second 506 and fourth 510 zones are packed in a square arrangement, while the springs 112 in the first 504, third 508, and fifth 512 zones are packed in a hexagonal arrangement. This illustrated combination of zones 114 provides greater support or firmness at the torso as well as the head and feet regions of an individual and more give at the shoulder/arms and leg regions of the individual. It should be recognized that the mattress 502 can have other combinations of zones 114 with different spring packing patterns. For instance, instead of the two different types of packing arrangements of the springs 112 shown in FIG. 5, the mattress 502 can have five different packing arrangements of the springs 112, one for each of the zones 114. Although the zones 114 illustrated in the drawings have generally the same size or width, it should be understood that mattresses in other embodiments can have zones 114 with varying widths. For instance, some of the zones 114 can be narrower than other zones 114.

Figure 7:
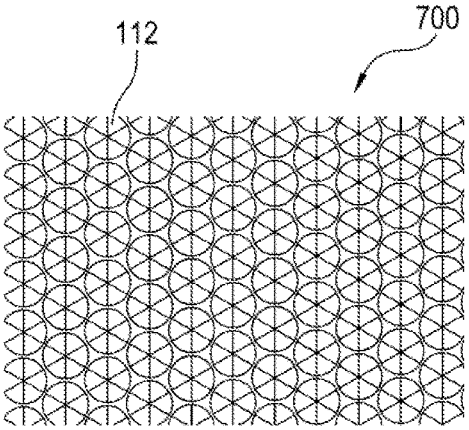
FIG. 7 shows the springs in at least one of the zones arranged in a triangular pattern.
Figure 8:
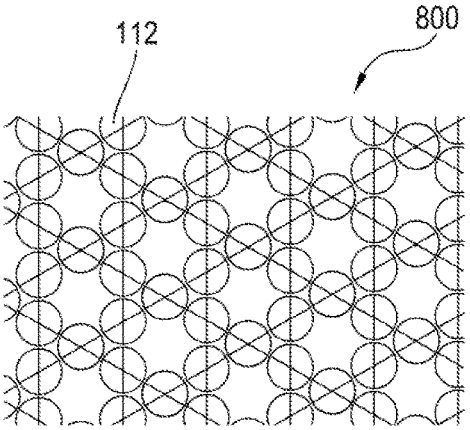
FIG. 8 shows the springs in at least one of the zones arranged in a trihexagonal pattern.
Figure 9:
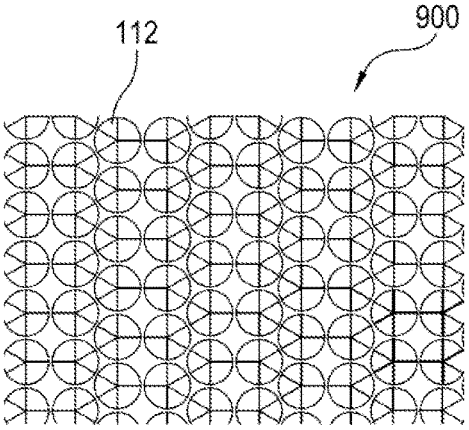
FIG. 9 shows the springs in at least one of the zones arranged in an elongated triangular pattern.
Figure 10:
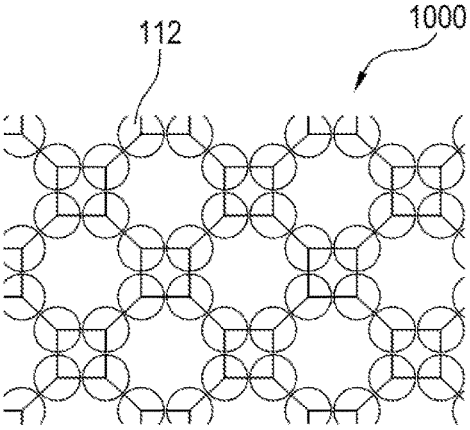
FIG. 10 shows the springs in at least one of the zones arranged in a truncated square pattern.
Figure 11:
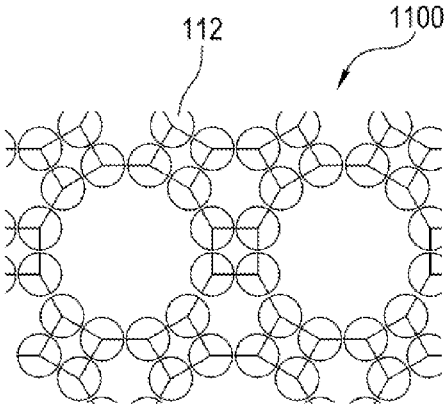
FIG. 11 shows the springs in at least one of the zones arranged in a truncated trihexagonal pattern.
Figure 12:
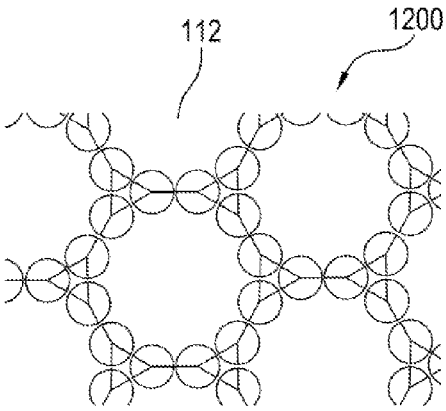
FIG. 12 shows the springs in at least one of the zones arranged in a truncated hexagonal pattern.
Figure 13:
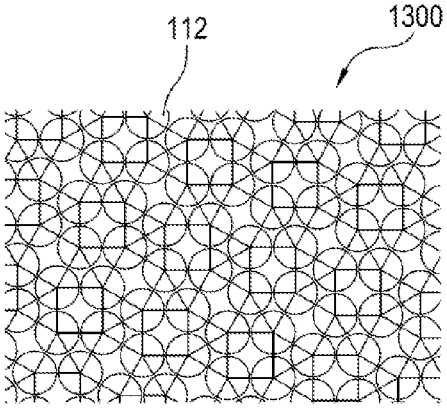
FIG. 13 shows the springs in at least one of the zones arranged in a snub square pattern.
Figure 14:
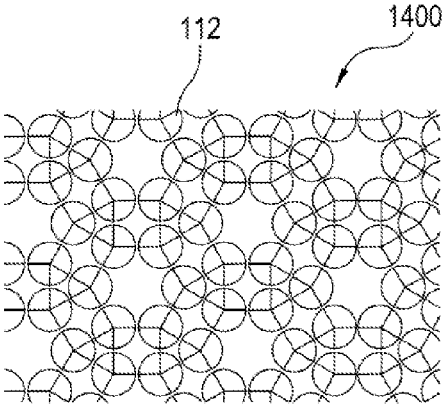
FIG. 14 shows the springs in at least one of the zones arranged in a rhombitrihexagonal pattern.
Figure 15:
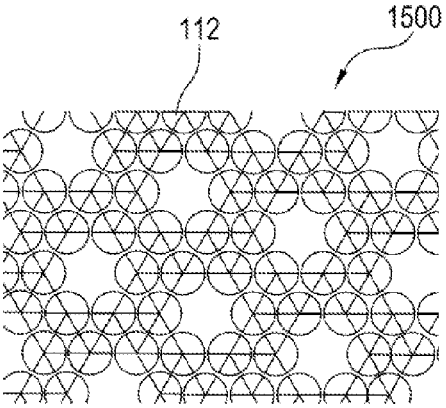
FIG. 15 shows the springs in at least one of the zones arranged in a snub hexagonal pattern.

A wide variety of different packing arrangements of springs 112 can be used in the zones 114. Moreover, different combinations of zones 114 with different packing arrangements of springs 112 can be incorporated into the mattresses. FIGS. 7-15 illustrate just a few different examples of uniform packing arrangements of the springs 112 in the zones 114. Again, the zones 114 in other examples can include nonuniform packing arrangements of the springs 112. FIG. 7 shows a triangular arrangement 700 of the springs 112 that can provide a somewhat firm support. FIG. 8 shows a trihexagonal arrangement 800 of the springs 112. The trihexagonal arrangement 800 in FIG. 8 has a lower packing density, and as such, the trihexagonal arrangement 800 of the springs 112 generally provides medium support or firmness. FIG. 9 shows an elongated triangular arrangement 900 of the springs 112. The packing arrangements of springs 112 in FIGS. 10, 11, and 12 create even softer zones 114 because the arrangements have lower packing density. In particular, FIG. 10 shows a truncated square 1000 packing arrangements of the springs 112. A truncated trihexagonal arrangement 1100 of the springs 112 is shown in FIG. 11, and FIG. 12 depicts a truncated hexagonal arrangement 1200 of the springs 112. The packing arrangements of the springs 112 shown in FIGS. 13, 14, and 15 have higher packing densities than those in FIGS. 10-12 such that the zones 114 containing the packing arrangements of the springs 112 shown in FIGS. 13, 14, and 15 will be firmer than those in FIGS. 10-12. As can be seen, FIGS. 13, 14, and 15 respectively depict the springs 112 for the zones arranged in a snub square 1300, a rhombitrihexagonal 1400, and a snub hexagonal arrangements. Again, it should be recognized that other different arrangements of springs 112 can be used in the zones 114.

As mentioned before, this unique design of using different spring packing patterns in the zones 114 to create varying firmness level areas within the mattresses allows the mattresses to be manufactured in the expensive manner because the same type of spring can be used to create the different zones 114. This eliminates the need of additional tooling and equipment required to handle and place springs having different physical properties. Different firmness level zones 114 can be created by simply adjusting the software in the equipment to pack the springs 112 in different patterns within the core 110 of the mattress. Changes in spring assembly patterns can be adjusted on the fly such that mattresses with different firmness profiles can be manufactured on the same equipment without any need to physically change over the equipment and/or the supply of springs 112. For instance, the mattress can be assembled with a computerized assembly machine that uses software programmed to place each spring 112 in the correct location. The software may be programmed to assemble different packing patterns of springs 112 in the various zones 114. The software may also be programmed to assemble the different embodiments with various placements of the zones. For example, the software may be programmed to create a three zone mattress or a five zone mattress.

A technique for manufacturing the inner cores 110 of the mattresses will now be described with reference to a flowchart 1600 shown in FIG. 16. The technique illustrated by FIG. 16 will be described with reference to a spring packing machine or robot, but it should be recognized that various stages of this technique can also be manually performed by a factory worker and/or semi-automatically performed by the factory worker in conjunction with a machine. To aid in understanding, this technique will be described with reference to the mattress 102 depicted in FIGS. 1-3, but it should be recognized that this technique can be used to create other types of mattresses such as the one illustrated in FIGS. 5 and 6 as well as other types. In stage 1602, the packing machine or robot packs the springs 112 in a first pattern to form the first zone 116 of the mattress 102. In the example illustrated in FIG. 3, the springs 112 are packed in a square pattern in the first zone 116, but it should be recognized that the springs 112 can be packed in other arrangements, such as those depicted in FIGS. 7-15. In stage 1604, the packing machine or robot packs the springs 112 in a second pattern for the second zone 118 that is different from the first pattern used to for the first zone 116. In both stages 1602 and 1604, the same type of spring 112 is packed to form both zones 114. Turning to the example illustrated in FIG. 3, the springs 112 in the second zone 118 are packed to form a hexagonal pattern. In other variations, the springs 112 in the second zone 118 can be packed using other types of patterns such as those illustrated in FIGS. 7-15. Again, by forming the zones 114 with different packing patterns, the resulting mattress 102 can have varying firmness profiles along the length 304 of the mattress 102 while still using the same type of spring 112 in all of the zones, if so desired. The first 116 and second 118 zones formed respectively in stage 1602 and stage 1604 are assembled together in stage 1606. It should be recognized that additional zones 114 can be added to the mattress 102 by repeating the various stages in the technique illustrated in the flowchart 1600 so as to make mattresses with three or more zones 114. In other variations, at least two of the zones 114 are made using the same type of spring 112 that are packed in different patterns, while one or more of the remaining zones 114 are made with one or more different types of springs 112.

Figure 16:
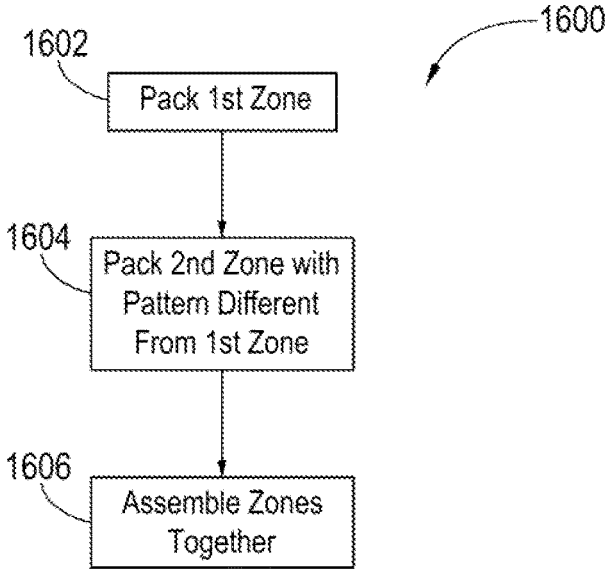
FIG. 16 is a flowchart illustrating a method of manufacturing a mattress with multiple spring zones.

It is contemplated that the stages illustrated in the flowchart 1600 in FIG. 16 can occur in a different order than what is illustrated. For instance, stage 1604 can occur before stage 1602. Moreover, two or more of the stages in the flowchart 1600 can occur simultaneously or be combined together. For example, both the first zone 116 (stage 1602) and the second zone 118 (stage 1604) can be packed at the same time. In another example, stages 1604 and 1606 can be combined together by packing the second zone 118 right next to the first zone 116 on the same platform. It further should be understood that this technique can be modified to incorporate additional stages or acts between the illustrated stages and/or various stages may be omitted if desired.

Figure 17:
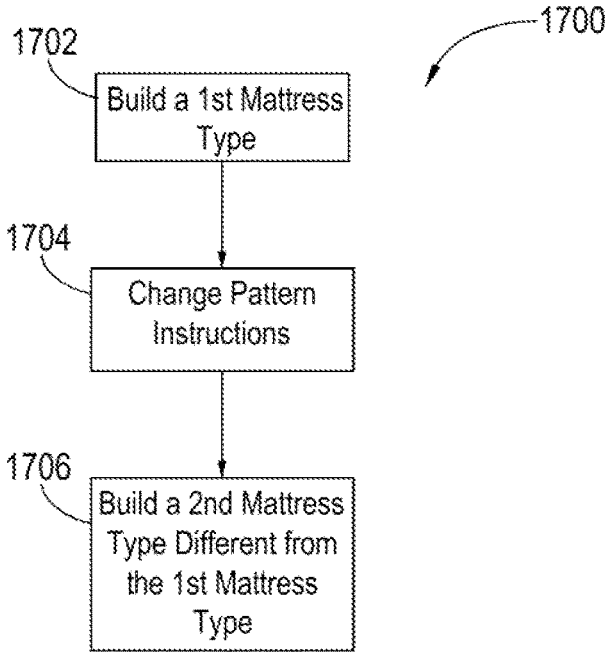
FIG. 17 is a flowchart illustrating a method of manufacturing mattresses with different spring zones.

As mentioned before, the above described technique of changing the spring placement pattern to form different zones or firmness profiles along a mattress helps to simplify changing over equipment between different mattresses designs that have different firmness profiles because the equipment does not have to be physically modified, but rather the instructions in the software for the spring patterns just has to be modified. With this technique, different mattress styles can be produced on the same assembly line rather easily. Customized mattresses can be produced on the same equipment without any significant delay between mattresses. One technique (of many) for switching between different mattress types that have different firmness profiles on the same equipment and/or assembly line will be described with reference to flowchart 1700 in FIG. 17. This technique illustrated by the flowchart 1700 in FIG. 17 will be described with reference to manufacturing the mattresses as illustrated in FIGS. 3 and 5, but it should be recognized that this technique can be used to switch between other types of mattress designs. In stage 1702, the FIG. 3 mattress 102 is assembled, such as in accordance with the technique described above with reference to FIG. 16. The software, firmware and/or other forms of pattern instructions for the spring packing machine or robot are switched in stage 1704 to a different pattern for producing a different type of mattress that has zones 114 with different firmness patterns or profiles. Alternatively or additionally, mechanical components on the assembly equipment, such as jigs, sensors, and mechanical stops, can be adjusted in stage 1704 to accommodate the different patterns. This change or switch in spring patterns can occur in any number of ways. For instance, the packing machine or robot in stage 1704 can be loaded with different software and/or data within the software can be modified so that it performs the different spring packing patterns. In another example, an operator simply makes a selection on the machine, such as by pushing a physical or virtual button, to pick a different mattress type or style. In stage 1706, a second mattress having a different comfort or firmness profile than the one manufactured in stage 1702 is assembled with the same packing machine or equipment, such as using the technique described above with reference to FIG. 16. For example, the FIG. 5 mattress 502 can be manufactured in stage 1706. As can be seen, the pattern of zones 114 in the FIG. 5 mattress 502 is quite different from the FIG. 3 mattress 102. It should be recognized that mattresses having different firmness zones and/or number of zones can be manufactured using the same equipment and springs with relatively short turn over time.

GLOSSARY OF DEFINITIONS AND ALTERNATIVES

The language used in the claims and specification is to only have its plain and ordinary meaning, except as explicitly defined below. The words in these definitions are to only have their plain and ordinary meaning. Such plain and ordinary meaning is inclusive of all consistent dictionary definitions from the most recently published Webster's and Random House dictionaries. As used in the specification and claims, the following definitions apply to the following terms or common variations thereof (e.g., singular/plural forms, past/present tenses, etc.):

"Mattress" generally refers to a large pad or fabric case filled with deformable or resilient material for supporting the reclining body, used as or on a bed for sleeping. Typically, but not always, the mattresses may include a quilted or similarly fastened case, usually of heavy cloth, that contains cotton or foam rubber; a framework or inner core of metal springs; or the mattress may be inflatable.

"Spring" generally refers to a resilient device, typically (but not always) a helical metal coil, that can be pressed or pulled but returns to its former shape when released. By way of nonlimiting examples, the springs can include various coil springs, pocket springs, Bonnell coils, offset coils, and/or continuous coils, to name just a few. As used herein, when spring are referred as being the "same" or "identical," it means that the springs are identified as being interchangeable parts (i.e., same part number) and/or share common physical characteristics, such as stiffness, gauge, coil type, shape, size, and weight, within normal engineering tolerances.

It should be noted that the singular forms "a", "an", "the", and the like as used in the description and/or the claims include the plural forms unless expressly discussed otherwise. For example, if the specification and/or claims refer to "a device" or "the device", it includes one or more of such devices.

It should be noted that directional terms, such as "up", "down", "top" "bottom", "fore", "aft", "lateral", "longitudinal", "radial", "circumferential", etc., are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A mattress, comprising:

a first zone having springs packed in a first pattern wherein the first pattern is a cube pattern;

a second zone having the springs packed in a second pattern that is different from the first pattern, wherein the second pattern is a hexagonal pattern;

wherein the first pattern of the springs in the first zone extend for an entire width of the mattress;

wherein the second pattern of the springs in the second zone extend for the entire width of the mattress; and wherein the springs in the entire mattress are metal coil springs that have the same stiffness, gauge, coil type, shape, size, and weight within normal engineering tolerances.

2. The mattress of claim 1, wherein the first pattern and the second pattern are each uniform repeating patterns that extend for the entire width of the mattress.

3. A mattress, comprising:

a first zone having springs packed in a first pattern;

a second zone having the springs packed in a second pattern that is different from the first pattern;

wherein the springs in the first zone and the second zone have the same stiffness;

wherein the springs in the entire mattress are metal coil springs that are interchangeable parts; and wherein the springs in the first zone have a packing density that is less than the packing density of the springs in the second zone.

4. The mattress of claim 3, wherein the first pattern and the second pattern are each uniform repeating patterns.

5. The mattress of claim 3, wherein:

the first pattern is a cube pattern; and the second pattern is a hexagonal pattern.

6. The mattress of claim 3, further comprising:

a third zone having the springs packed in a third pattern.

7. The mattress of claim 6, wherein the first pattern and the third pattern are the same pattern.

8. The mattress of claim 6, wherein:

the first pattern and the third pattern have a cube pattern; and the second pattern is a hexagonal pattern.

9. The mattress of claim 6, further comprising:

a fourth zone having the springs packed in a fourth pattern;

a fifth zone having the springs packing in a fifth pattern;

wherein the first pattern, the third pattern, and fifth pattern are the same; and wherein the second pattern and the fourth pattern are the same.

10. The mattress of claim 3, wherein the springs are pocket springs.

11. The mattress of claim 3, wherein:

the mattress has a width; and the first pattern of the springs in the first zone extend for the entire width of the mattress; and the second pattern of the springs in the second zone extend for the entire width of the mattress.

12. The mattress of claim 3, further comprising:

an upholstery layer covering the first zone and the second zone.

13. A method, comprising:

packing springs in a first pattern in a first zone of a core of a mattress;

packing the springs in a second pattern that is different from the first pattern in a second zone of the core;

wherein the first pattern and the second pattern are each uniform repeating patterns;

wherein the springs in the first zone and the second zone are metal coil springs;

wherein the springs in the first zone and the second zone are interchangeable parts; and wherein the springs in the first zone have a packing density that is less than the packing density of the springs in the second zone.

14. The method of claim 13, wherein:

said packing the springs in the first pattern includes packing the springs for an entire width of the mattress in the first pattern; and said packing the springs in the second pattern includes packing the springs for the entire width of the mattress in the second pattern.

15. The method of claim 13, further comprising:

packing the springs in a third pattern in a third zone of the core, wherein the second zone is sandwiched between the first zone and the second zone; and wherein the first pattern and the second pattern have the same pattern.

16. The method of claim 13, further comprising:

assembling a second core of a second mattress that has a firmness profile different from a firmness profile created by the first and second zones of the mattress.

17. A method, comprising:

packing springs in a first pattern in a first zone of a core of a mattress, wherein said packing the springs in the first pattern includes packing the springs in a cube pattern;

packing the springs in a second pattern that is different from the first pattern in a second zone of the core, wherein said packing the springs in the second pattern includes packing the springs in a hexagonal pattern;

wherein the first pattern and the second pattern are each uniform repeating patterns;

wherein the springs in the first zone and the second zone are metal coil springs; and wherein the springs in the first zone and the second zone are interchangeable parts.

18. The method of claim 17, wherein:

said packing the springs in the first pattern includes packing the springs for an entire width of the mattress in the first pattern; and said packing the springs in the second pattern includes packing the springs for the entire width of the mattress in the second pattern.

19. The method of claim 17, further comprising:

packing the springs in a third pattern in a third zone of the core, wherein the second zone is sandwiched between the first zone and the second zone; and wherein the first pattern and the second pattern have the same pattern.

20. The method of claim 17, further comprising:

assembling a second core of a second mattress that has a firmness profile different from a firmness profile created by the first and second zones of the mattress.

21. A mattress, comprising:

a first zone having springs packed in a first pattern;

a second zone having the springs packed in a second pattern that is different from the first pattern;

wherein the springs in the first zone and the second zone have the same stiffness;

wherein the springs in the entire mattress are metal coil springs that are interchangeable parts; and wherein the springs in the first zone have a packing density that is greater than the packing density of the springs in the second zone.

22. The mattress of claim 21, wherein:

the mattress has a width; and the first pattern of the springs in the first zone extend for the entire width of the mattress;

the second pattern of the springs in the second zone extend for the entire width of the mattress.

23. The mattress of claim 21, further comprising:

a third zone having the springs packed in a third pattern; and wherein the first pattern and the third pattern are the same pattern.

24. The mattress of claim 21, wherein:

the first pattern is a cube pattern; and the second pattern is a hexagonal pattern.

* * * * *